US005481761A

United States Patent [19]

Lichti

[11] Patent Number: 5,481,761

[45] Date of Patent: Jan. 9, 1996

[54] SLEEVE SUPPORT

[76] Inventor: Cheryle Lichti, 14311 - 117 Street, Edmonton, Alberta T5X 1N3, Canada

[21] Appl. No.: 302,023

[22] Filed: Sep. 12, 1994

[51] Int. Cl.[6] ..... A41D 27/26

[52] U.S. Cl. ..... 2/268; 2/255; 2/267

[58] Field of Search ..... 2/268, 255, 267, 2/75, 106; 450/86

[56] References Cited

U.S. PATENT DOCUMENTS

| | | | |
|---|---|---|---|
| 2,258,937 | 10/1941 | Nielsen | 2/268 |
| 2,421,895 | 6/1947 | Leebow | 2/268 |
| 2,483,809 | 10/1949 | Clark et al. | 2/268 |

*Primary Examiner*—C. D. Crowder
*Assistant Examiner*—Shirra L. Jenkins
*Attorney, Agent, or Firm*—George A. Seaby

[57] ABSTRACT

The shoulder area of wedding and party dresses are usually puffed up using crinoline netting, which is very cumbersome and difficult to work. A simple solution to this problem includes a fabric panel in the shape of a truncated segment of a circle with a pocket in the long straight edge thereof. When the convex side of the panel is pleated or otherwise gathered, the panel assumes an arch shape. Inserting of a resilient strip of plastic into the pocket and sewing of the gathered edge into a sleeve at the seam between the bodice and sleeve of a garment results in a puffy shoulder which retains its shape.

6 Claims, 4 Drawing Sheets

SLEEVE SUPPORT

BACKGROUND OF THE INVENTION

1. Field of the Invention

This invention relates to a clothing support, and in particular to a sleeve stay.

2. Discussion on the Prior Art

The sleeve stay of the present invention is primarily intended for use in women's and girls clothing, and in costumes for maintaining puffiness in the shoulder sleeve area of the garment. At present, the usual method of achieving puffiness in the shoulders of clothing such as wedding or party dresses is to incorporate a gathered strip or strips of crinoline netting in the shoulder area. Crinoline or similar fabrics are cumbersome, being stiff and somewhat difficult to work. Thus, the production of clothing with puffy shoulders is labour intensive and consequently expensive. Moreover, such articles of clothing do not keep their shape, and are uncomfortable.

GENERAL DESCRIPTION OF THE INVENTION

An object of the present invention is to provide a solution to the above mentioned problems in the form of a relatively simple sleeve stay which is easy to install, and which retains its shape even when the garment incorporating the stay is washed, packaged, shipped or dry cleaned.

Another object of the invention is to provide a sleeve stay which is more resilient, permanent and stable than existing products designed to achieve the same results.

Yet another object of the invention is to provide a sleeve stay, which, while lightweight, is strong and comfortable even in heavy garments, and which facilitates the production of relatively large sleeves.

Accordingly, the invention relates to a sleeve stay comprising elongated, fabric panel means, said panel means having a first edge; and resilient strip means connected to said first edge, whereby when an edge opposite said first edge is gathered, said resilient strip means is bent to form an arch for supporting the sleeve of a garment, imparting puffiness thereto.

BRIEF DESCRIPTION OF THE DRAWINGS

The invention will be described in greater detail with reference to the accompanying drawings, which illustrate preferred embodiments of the invention, and wherein.

Wherever possible the same reference numerals have been used to identify the same or similar elements in the various figures of the drawings.

DESCRIPTION OF THE PREFERRED EMBODIMENT

Figure 1:
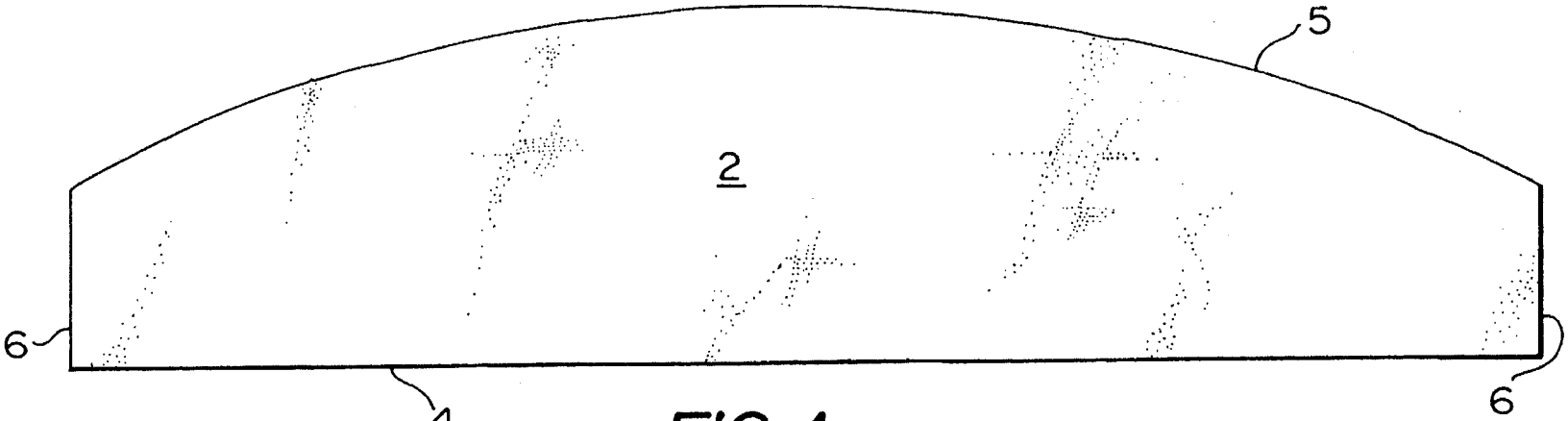
FIG. 1 is a side view of a blank used in the stay of the present invention.
Figure 2:
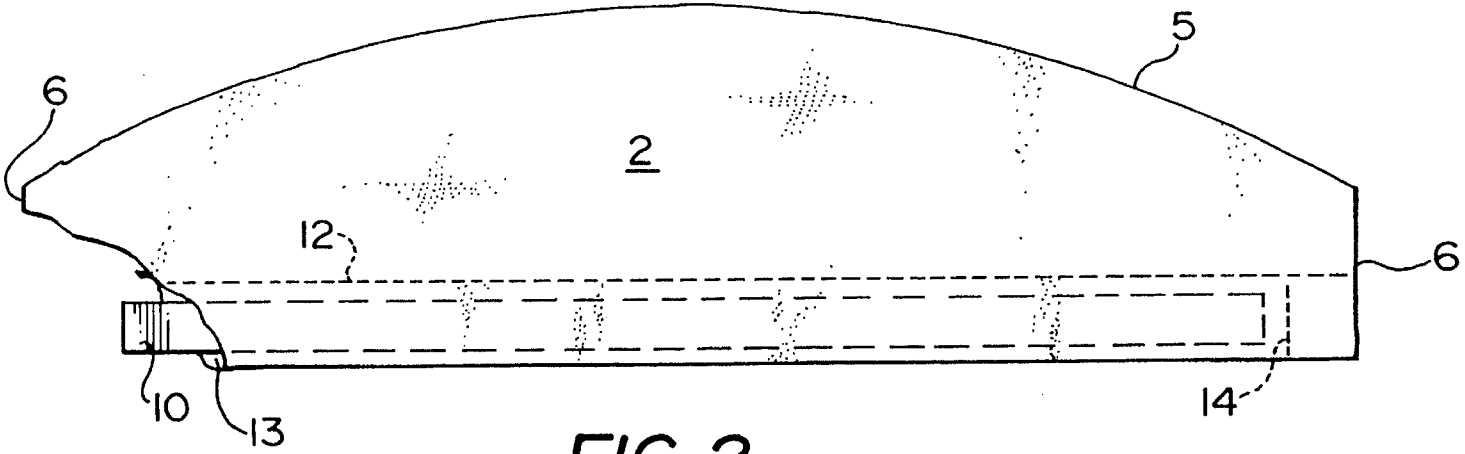
FIG. 2 is a partly sectioned side view of a partially completed stay in accordance with the invention.
Figure 3:
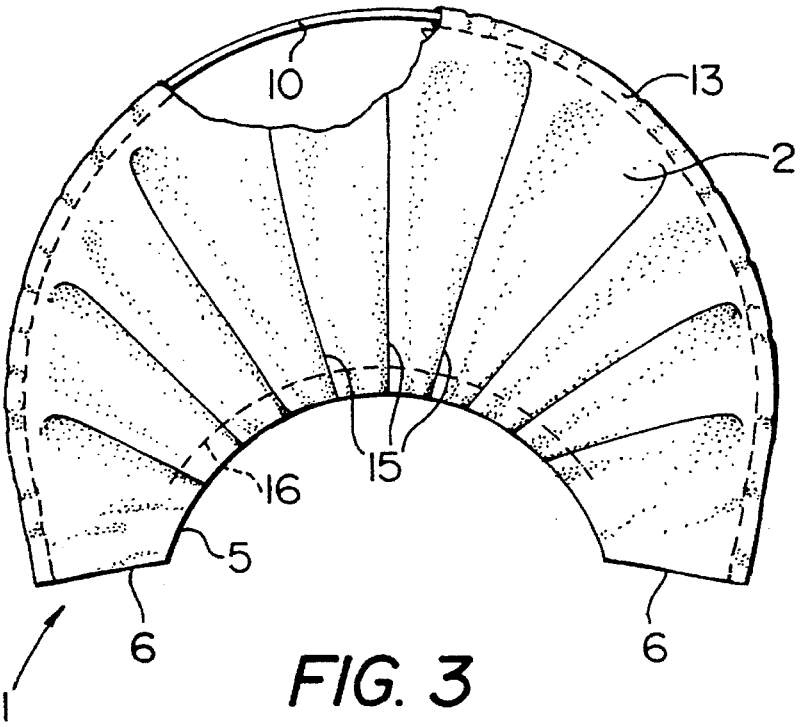
FIG. 3 is a partly section side view of a completed stay.

Referring to FIGS. 1 to 3, of the drawings, a stay generally indicated at 1 in FIG. 3 is formed using a blank defined by a flat, elongated, soft fabric sheet or panel 2. Suitable fabrics for use in the panel 2 include satins, organzas, taffetas, general broadcloth or even the fabric used in the garment to contain the stay. If the area of the garment incorporating the stay is transparent, the panel 2 can be made of the same fabric to make its presence less obvious.

The elongated panel 2 includes a straight edge 4 on one side thereof, a convex edge 5 opposite the straight edge 4, and a pair of straight ends 6 perpendicular to the straight edge 4. In order to form a stay for the shoulder portion of the sleeve 8 of a dress 9 (FIG. 4), a resilient plastic strip 10 is mounted on or in the panel 2. The straight edge 4 of the panel 2 is folded over and sewed with a line of stitching 12 to form a pocket or sleeve 13. One end of the pocket 13 is closed by a line of stitching 14, the strip 10 is inserted into the pocket, and the pocket is closed by a second line of stitching (not shown). The strip 10, which is commonly known as boning, is flat and narrow (usually ¼ to ½ inch). The strip is produced of plastic, and must be sufficiently strong and resilient that it does not readily develop a permanent crease if pinched or pressed. In some cases, a plurality of strips 10 are used to form a laminate which ensures strength and durability.

As best shown in FIG. 3, in order to produce a stay generally indicated at 1, the convex edge 5 of the panel 2 is gathered by forming pleats 15. The pleats 15 are fixed in position by a line of stitching 16 extending parallel to the convex edge 5. Thus, the edge 5 is forced to assume a concave shape. The strip 10 is inserted into the pocket 13, and the resulting stay 1 is sewn into the seam (not shown) between the sleeve 8 and the bodice 17 of the dress 9. The strip 10 causes the straight edge 4 to become convex, defining the outer periphery of a wide, generally C-shaped arch. By making the sleeve 8 full around the arch, the stay 1 maintains the sleeve in a puffy condition in essentially the same manner as the conventional crinoline netting. The difference is that the strip 10 does not readily become deformed but, being resilient, resumes its shape when pressure is applied thereto and released. The length of the panel 2 determines the circumference of the puff, and the number and extent of gathering or pleating determines the height of the puff.

It will be appreciated that the strip 10 could be formed of so-called sew-through-boning, which would be connected to the straight edge 4 of the panel 2 without using a pocket or sleeve. However, this structure necessitates the sacrificing of the option of readily reducing the length of the strip 10. When a pocket or sleeve 13 is used, the strip 10 can be inserted before, during or after the attaching of the panel 2 to a dress. The ability to readily insert and remove the insert 10 is important, especially when producing a small sleeve, e.g. in a child's dress, because a small, stiff arch creates resistance the closer the arch to the seam line between the sleeve and the bodice 17 of the dress 9.

Figure 5:
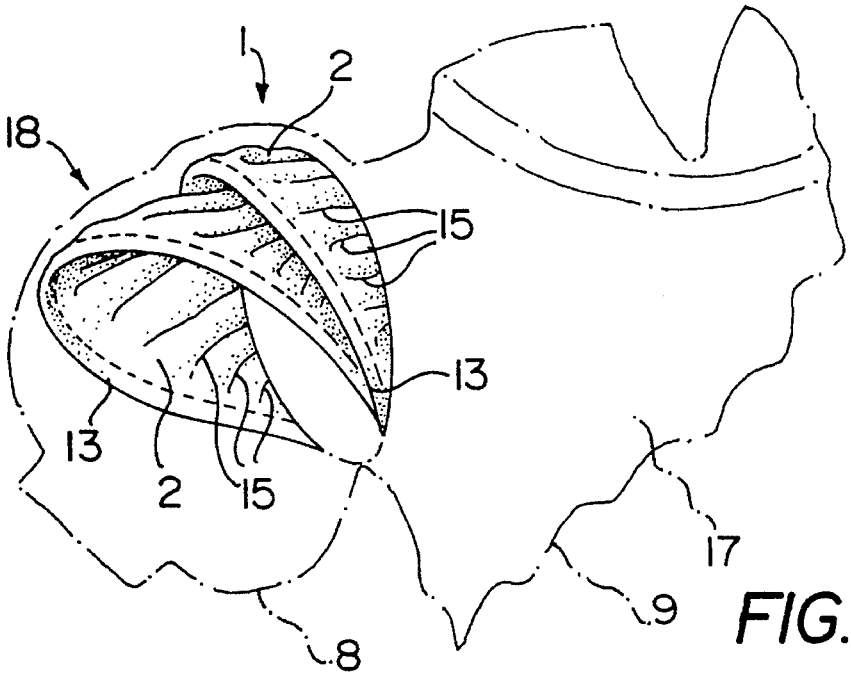
FIG. 5 is a perspective view of a portion of a dress incorporating a second embodiment of the stay of the present invention.

Referring to FIG. 5, a pair of stays 1 and 18 can be used to form a double arch in a sleeve 8. In this case, the inner or bottom edges of two stays 1 and 18 are sewn together in the sleeve 8 at the junction between the sleeve and the bodice 17 of the dress 9. The outer or lower stay 18 is wider than the inner or upper stay 1. Not only does the use of two stays 1 and 18 produce puffiness, but the two stays result in a wider area of puffiness. The upper stay 1 provides height and the lower stay 18 provides length to the area of puffiness.

Figure 4:
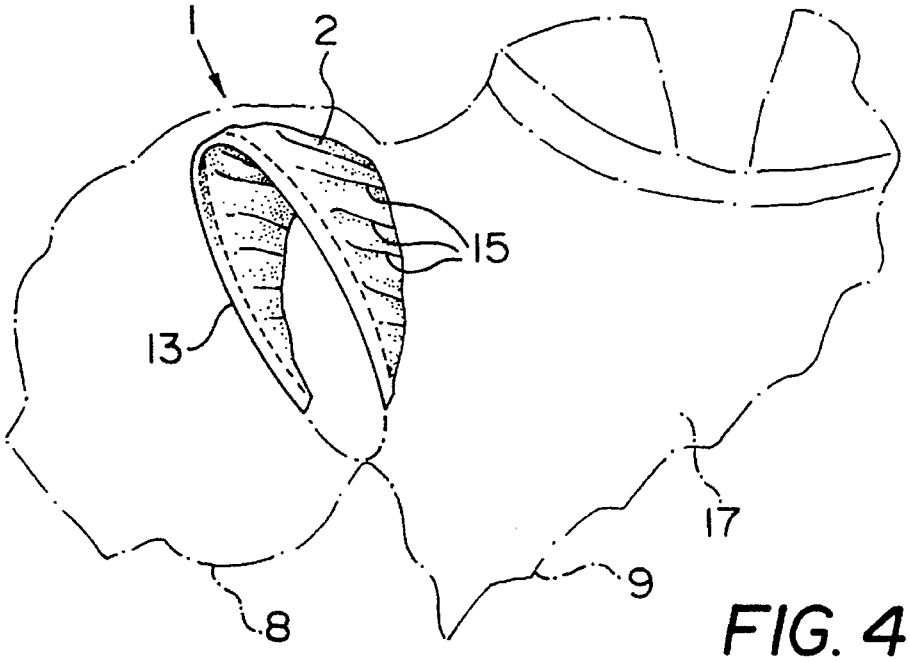
FIG. 4 is a schematic perspective view of a portion of a dress incorporating the stay of FIGS. 2 and 3.

Additional puffiness can be imparted to the structures of FIGS. 4 and 5 by adding a layer or layers of gathered crinoline netting (not shown) to the top, outer surface of the stay(s). The crinoline fabric gives the finished garment a softer fluffy appearance, and disguises any ridged appearance caused by the strips 10, especially when the external fabric is soft. Substantially less netting is used than in current puffed garments. The crinoline netting is gathered and then applied just inside the stitch line of the edge 5 after it has become concave by the pleating. It is important that the netting be inside the stitch line of the pleating so that when the stay 1 is joined to the sleeve seam the skin is not exposed to any netting. Thus, while considerable puffiness is achieved, there is no discomfort as a result of the use of crinoline.

While, as shown in FIG. 3, the partially closed stay 1 can be used to form an arch, the stay can also be fully closed to form a loop 19 (FIG. 6) which is sewn into a sleeve 8 in the manner illustrated in FIG. 4. In such case, the ends 20 of the loop 19 are overlapped and the loop is sewn into a sleeve in the same manner as the arch of FIGS. 3 and 4.

Figure 6:
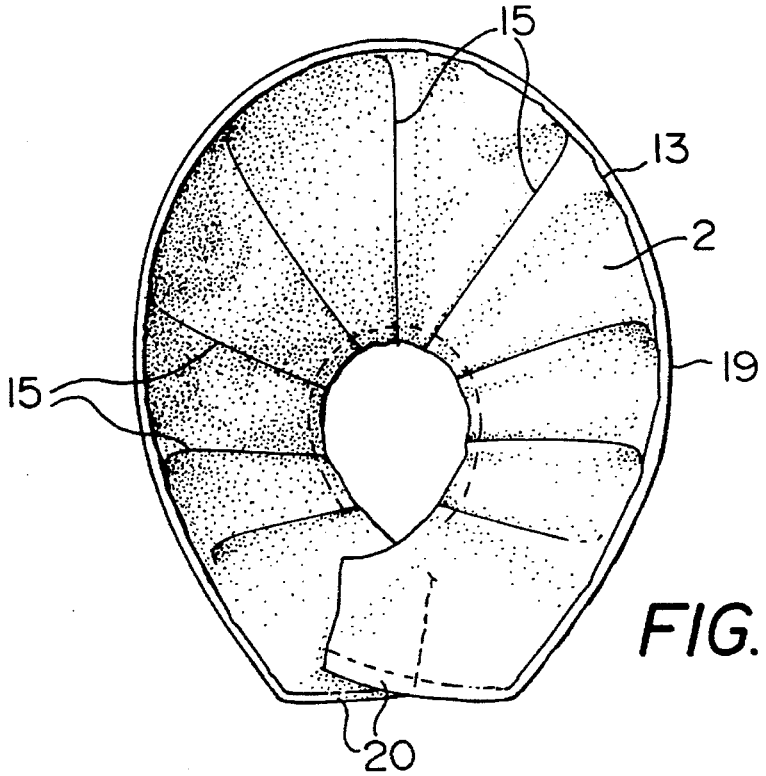
FIG. 6 is a side view of the a second form of completed stay.
Figure 7:
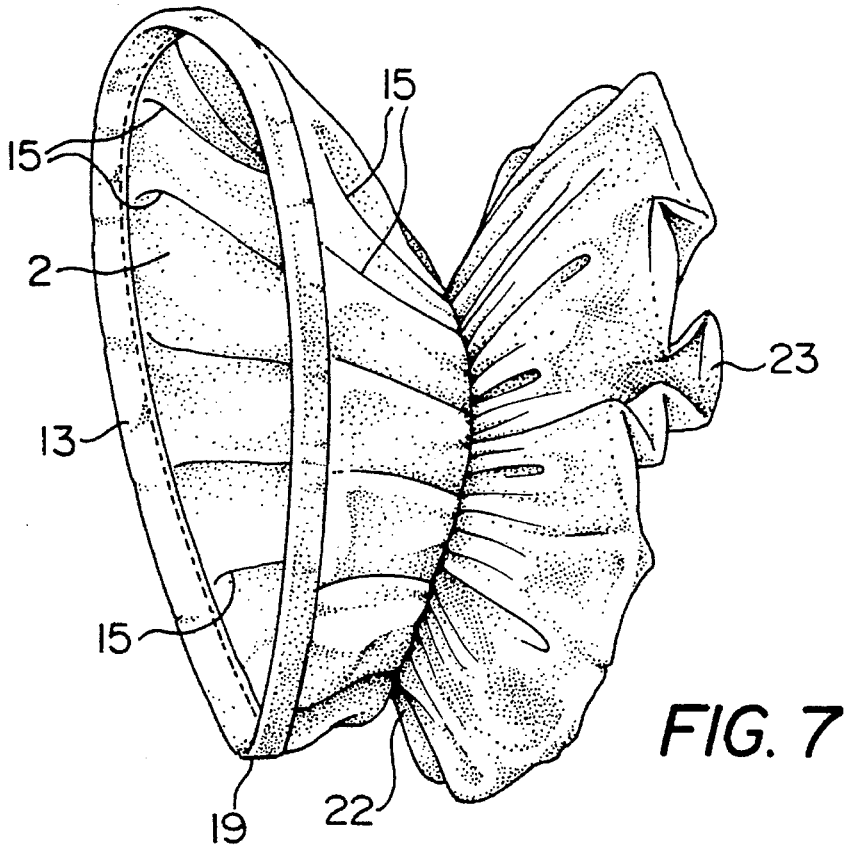
FIG. 7 is a perspective view of a third embodiment of the stay of the present invention.

Referring to FIG. 7, in another embodiment of the invention, the narrow end 22 of a loop 23 of a crinoline fabric is attached to the narrow end of a loop 19 of the type illustrated in FIG. 6, and the resulting assembly is sewn into the top end of a sleeve 8. It is important to prevent contact of the crinoline fabric with the skin. The crinoline fabric adds extra puffiness in the shoulder area of the dress.

Figure 8:
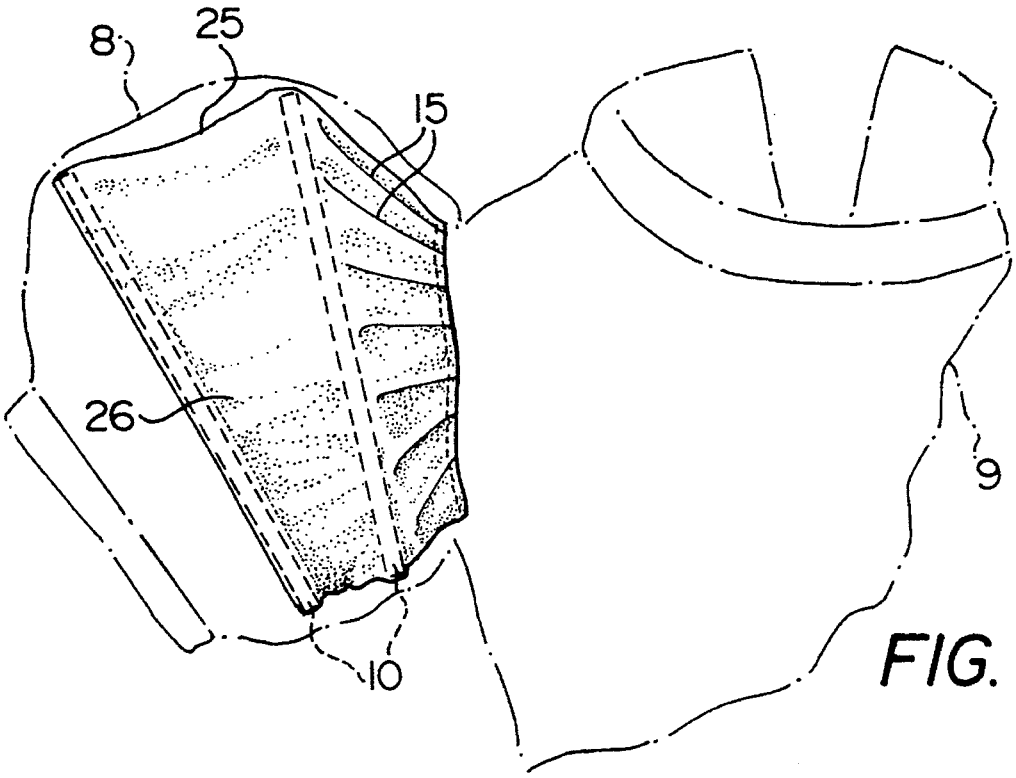
FIG. 8 is a schematic front view of a portion of a dress incorporating a fourth embodiment of the stay of the present invention.

With reference to FIG. 8, in yet another embodiment of the invention, the panel 2 is replaced by a wider panel 25, and a pair of strips 10 are mounted in the panel to extend the length of the area of puffiness along a substantial portion of the sleeve 8 of the dress 9. The outer portion 26 of the panel between the strips 10 is not gathered.

I claim:

1. A sleeve stay comprising elongated, fabric panel means, said panel means including a first straight edge and a second convex edge opposite said first edge; resilient arcuate strip means connected to said first edge, said strip means and said panel means curving, whereby said first edge and said strip means define a segment of a circle and said panel means defines an arch, said first edge defining the outer edge of the arch when the stay is mounted in a sleeve, said strip means imparting sufficient rigidity to the arch to support the sleeve of a garment; and a plurality of pleats in said second edge extending towards said first edge and imparting puffiness to the stay.

2. A sleeve stay according to claim 1, wherein said panel means includes pocket means proximate said first edge for receiving said strip means.

3. A sleeve stay according to claim 2, wherein said panel means includes, third and fourth edges perpendicular to said first edge, whereby the panel means defines a truncated segment of a circle.

4. A sleeve stay according to claim 3, wherein said third and fourth edges of said panel means are interconnected.

5. A sleeve stay according to claim 3, including a pair of said panel means, and arcuate strip means in each said panel means; and stitching means interconnecting said panel means at said third and fourth ends with said first edge of one said panel means overlapping the second edge of the other said panel means to impart additional puffiness to a sleeve.

6. A sleeve stay according to claim 4, including a loop of crinoline connected to said second edge for adding puffiness to the stay.

* * * * *